US005758624A

United States Patent [19]

Satou et al.

[11] Patent Number: 5,758,624

[45] Date of Patent: Jun. 2, 1998

[54] IGNITION COIL AND METHOD OF MANUFACTURING THE SAME

[75] Inventors: Yoshitaka Satou, Toyohashi; Kazutoyo Oosuka, Gamagori; Masami Kojima, Chiryu; Masato Ichikawa, Kariya; Mamoru Urushizaki, Chiryu, all of Japan

[73] Assignee: Denso Corporation, Kariya, Japan

[21] Appl. No.: 803,533

[22] Filed: Feb. 20, 1997

[30] Foreign Application Priority Data

Mar. 22, 1996 [JP] Japan ..... 8-066152
Jun. 13, 1996 [JP] Japan ..... 8-152133

[51] Int. Cl.[6] ..... F02D 15/00

[52] U.S. Cl. ..... 123/634; 123/647

[58] Field of Search ..... 123/634, 635, 123/647, 169 PA; 361/622, 623, 728, 736

[56] References Cited

U.S. PATENT DOCUMENTS 5,296,999 3/1994 Taruya ..... 361/247
5,632,259 5/1997 Konda et al. ..... 123/634

FOREIGN PATENT DOCUMENTS 63-70508 3/1988 Japan .

*Primary Examiner*—Willis R. Wolfe
*Assistant Examiner*—Hieu T. Vo
*Attorney, Agent, or Firm*—Cushman, Darby & Cushman IP Group of Pillsbury, Madison & Sutro LLP

[57] ABSTRACT

An ignition coil is composed of a transformer, an igniter, a housing accommodating them and a fixing portion disposed at a place within easy access from an opening of the housing to fix the igniter, a terminal pin disposed at a place of the housing within easy access from the opening and connected to the control circuit and a connector pin fixed to the housing and connected to the terminal pin. The igniter and fixing portion have a member for adjusting relative location therebetween to connect the connector pin and terminal pin without stress.

6 Claims, 10 Drawing Sheets

IGNITION COIL AND METHOD OF MANUFACTURING THE SAME

CROSS REFERENCE TO RELATED APPLICATION

The present application is based on and claims priority from Japanese Patent Applications, Hei 8-66152, filed on Mar. 22, 1996, and Hei 8-152133, filed on Jun. 13, 1996, the contents of which are incorporated herein by reference.

BACKGROUND OF THE INVENTION

1. Field of the Invention

The present invention relates to an ignition coil for an internal combustion engine and a method of manufacturing an ignition coil, particularly, for an automobile.

2. Description of the Related Art

An ignition coil is sometimes provided with an igniter or an ignition control circuit integrally therein. The igniter controls the primary current of the ignition coil to generate an ignition voltage across the secondary coil to be supplied to a spark plug. The igniter has a plurality of lead wires extending from the ignition coil to be connected to outside sensors and devices by means of soldering or welding.

JPA 63-70508 discloses an ignition coil for an internal combustion engine which has an integrated igniter with a plurality of lead wires extending outward from the ignition coil. The lead wires are connected to respective terminals of a power switch of the igniter. The power switch is disposed on a resin mold at an upper portion of the ignition coil, and one of the lead wires extending from a side of the power switch is connected to a lead wire extending to the outside from the housing of the ignition coil. For this purpose, the power switch is bonded to the resin mold by an adhesive agent or the like, and thereafter the power switch is connected to the lead wire.

In this process, however, either one of the terminal of the power switch and the lead wire has to be moved or bent to connect each other by a tool. As a result, the connecting portion may have a remaining stress, which may separate the terminal and the lead wire of thereof by accident.

SUMMARY OF THE INVENTION

The present invention has an object of providing an improved ignition coil and method for manufacturing the same.

Another object of the present invention is to provide an ignition coil having an igniter that is connected to terminals easily without stress and that not separate the terminal and the lead wire by accident.

According to a feature of the present invention, an ignition coil is composed of a transformer, an igniter for controlling generation of high voltage, a housing having an opening with a size for allowing the transformer and igniter to pass therethrough and a fixing portion disposed at a place within easy access from the opening, a terminal pin disposed at a place of the igniter within easy access from the opening and connected to the control circuit, and a connector pin fixed to the housing and connected to the terminal pin.

Another object of the present invention is to provide an improved method of manufacturing a compact ignition coil.

According to another feature of the present invention, a method is composed of steps of inserting the transformer into the housing, placing the igniter on an upper portion of the housing above the transformer, moving the igniter to adjust position of the terminal pin to the connecter pin, pressing the terminal pin and connector pin by a pair of electrodes to weld the terminal pin and the connector pin, melting a connecting portion of the igniter and the housing to bond each other, pouring an insulating oil into the housing and sealing the housing by a cover by caulking the cover to the housing.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS (First Embodiment)

A first embodiment according to the present invention is described with reference to FIGS. 1 to 9.

Figure 1:
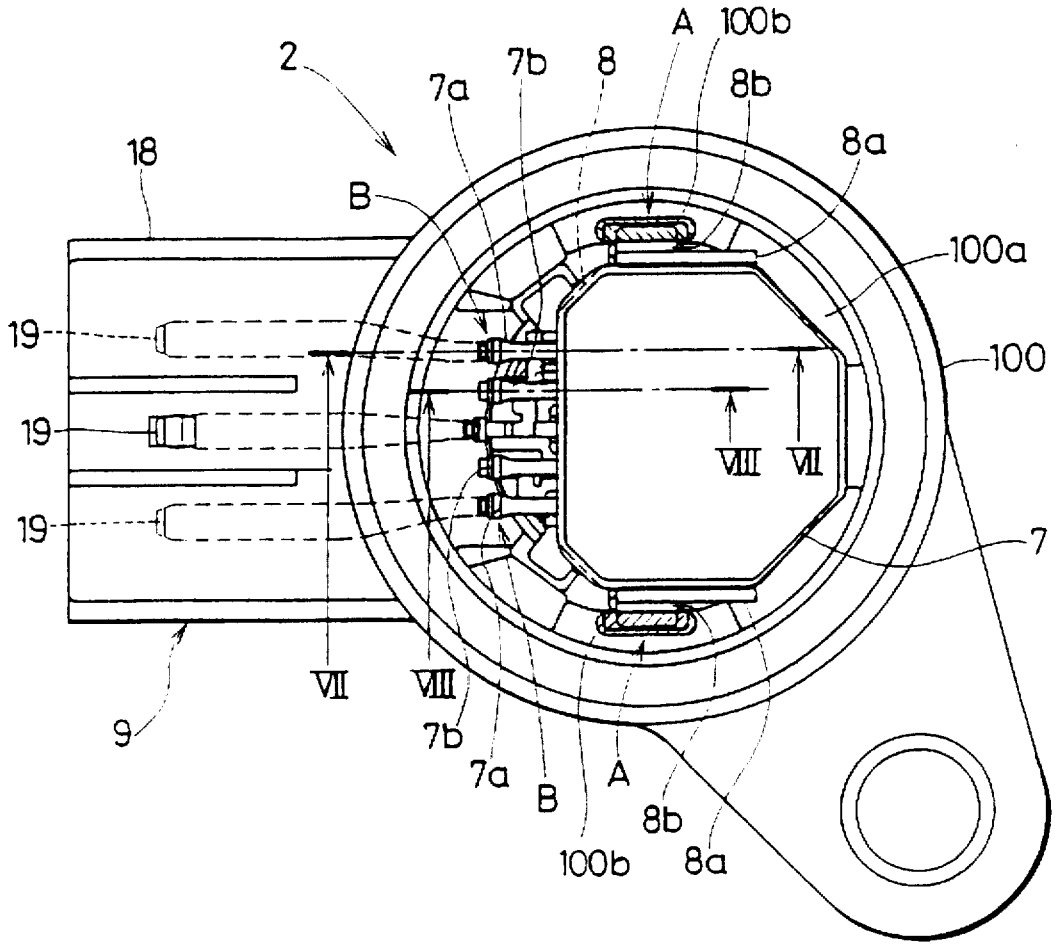
FIG. 1 is a plan view illustrating an ignition coil without a coil cap according to a first embodiment of the present invention.
Figure 2:
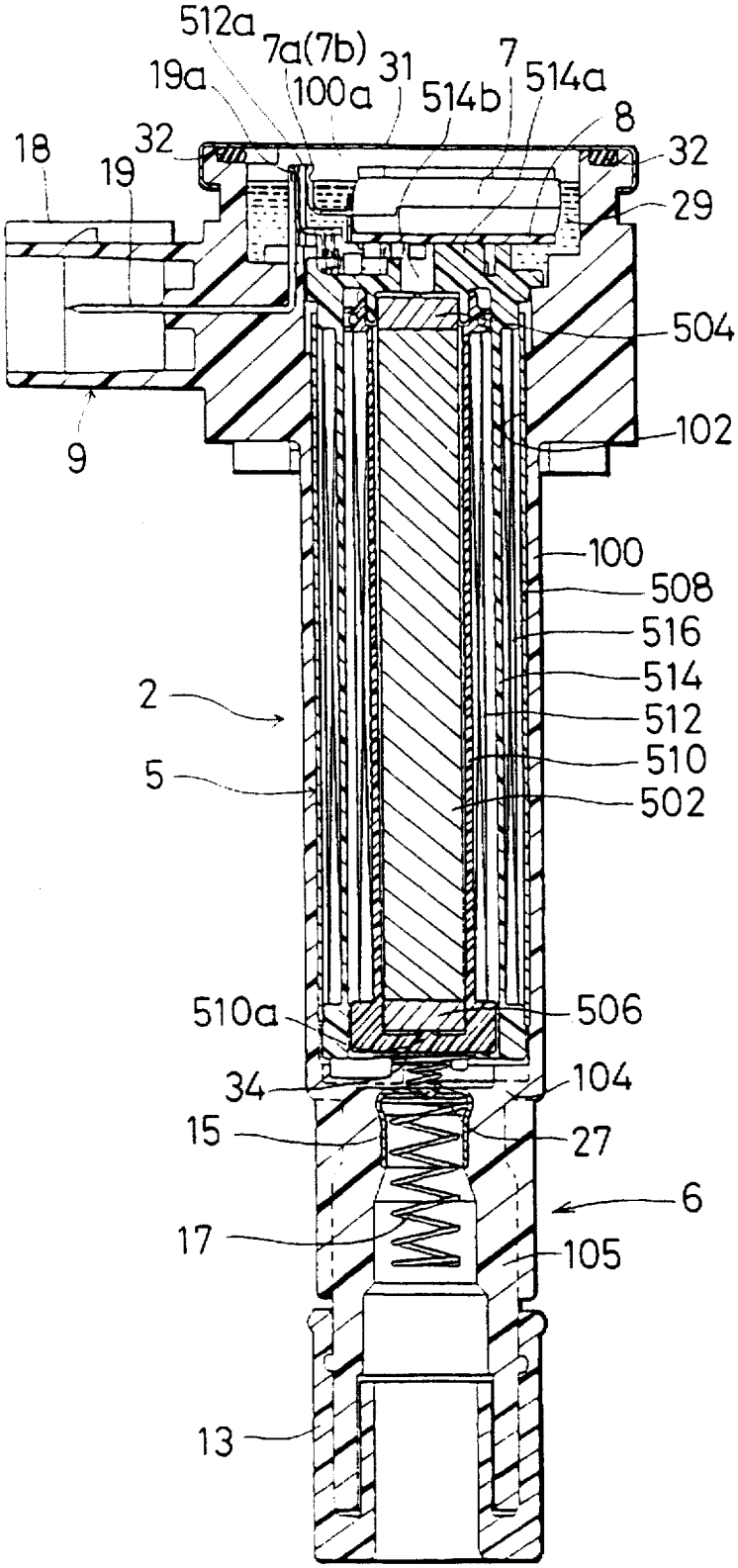
FIG. 2 is a cross-sectional side view illustrating the ignition coil according to the first embodiment.
Figure 3:
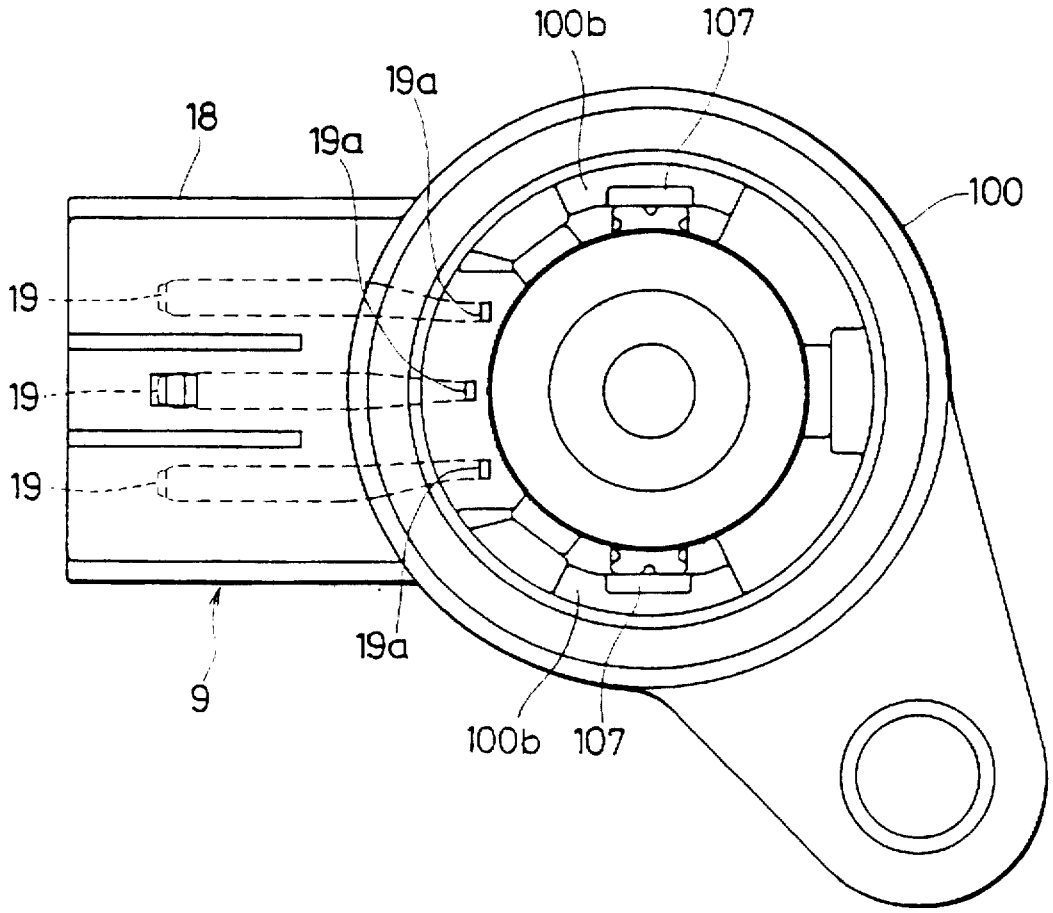
FIG. 3 is a plan view illustrating a case of the ignition coil.

As shown in FIGS. 1 and 2, an ignition coil 2 is composed of a cylindrical transformer section 5, an igniter 7 disposed at the upper end of the transformer section 5 to switch on and off the primary current of the transformer section 5, a plug-cap section 6 disposed at the bottom of the transformer section 5 to connect to a spark plug (not shown).

The ignition coil 2 has a cylindrical case 100 made of a resinous material, which accommodates the transformer section 5, the igniter 7 and insulating oil 29 in the chamber 102 thereof. The case 100 has an upper opening 100*a* through which the transformer section 5 and the igniter 7 are put in and the insulating oil is poured. The upper opening 100*a* is hermetically closed by a metal cover 31 which is fixed on the outer fringe of the opening 100*a* by caulking via an 0-ring 32 as shown in FIG. 2. The case 100 also has a bottom portion 104 with a through hole closed by a cup 15, which is enclosed by the plug-cap section 6.

A control-signal connector 9 is disposed at an upper periphery of the case 100, which has a connector housing 18 integrated with the case 100 and three connector pins 19 therein. One end 19*a* of each of the connector pins 19 extends inside the case 100 within easy access from the opening 100*a*.

The case 100 has also a pair of mount sections 100*b* formed on the upper portion thereof to support the igniter 7 via a holder 8. A groove 107 is formed on each of the mount sections 100*b* in parallel with each other to extend toward the control- signal connector 9 so that the connection work between connector pins 19 of the control-signal connector 9 and input and output pins 7*a* and 7*b* of the igniter 7 can be carried out through the opening 100*a*. The holder 8 has a pair of projections 8*c* as shown in FIG. 5, which is inserted slidably into the grooves 107. Accordingly, the position of the holder 8 and the igniter 7 can be adjusted when input and output pins 7*a* and 7*b* of the igniter are connected to the ends 19*a* of the pins 19.

Figure 4A:
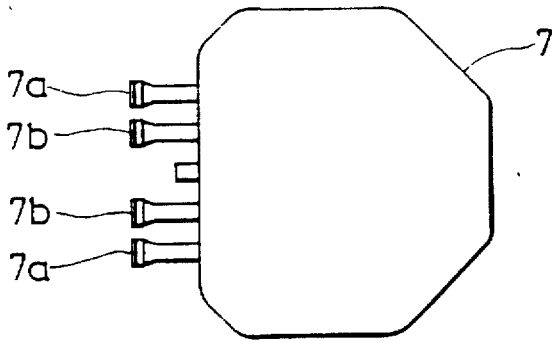
FIG. 4A is a plan view of an igniter of the ignition coil according to the first embodiment.
Figure 4B:
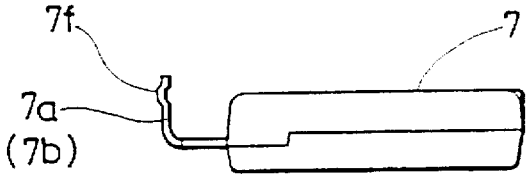
FIG. 4B is a side view illustrating the same.

As shown in FIGS. 4A and 4B, the igniter 7 is generally flat and is composed of an igniter case made of a resinous material, a hybrid IC unit (not shown) covered with the case, the input pins 7*a* and output pins 7*b*. Each of the input and output pins 7*a* and 7*b* has an L-shaped cross-section formed with a projection 7*f*, which reinforces the portion connected to each of the connector pins 19 by resistance welding, laser welding or the like.

Figure 9:
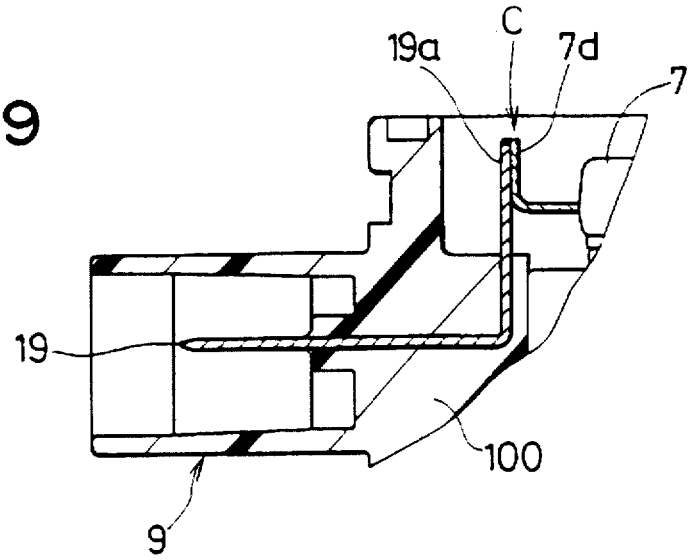
FIG. 9 is a cross-sectional view illustrating a portion of an ignition coil which is a variation of the first embodiment.

However, the projection 7f is not always necessary and can be omitted as shown in FIG. 9.

Figure 5A:
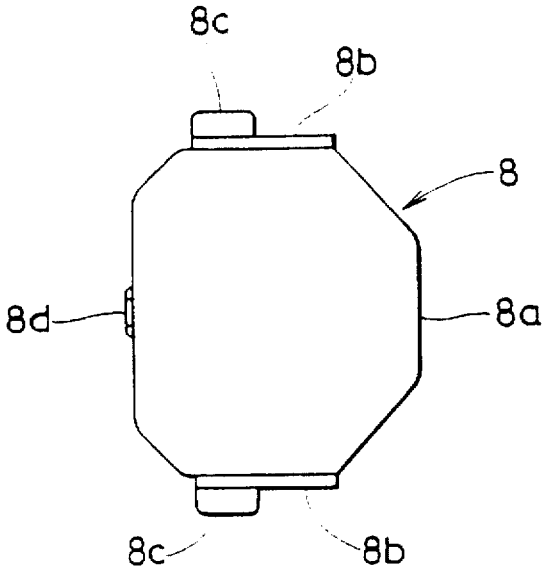
FIG. 5A is a plan view illustrating a holder of the ignition coil according to the first embodiment.
Figure 5B:
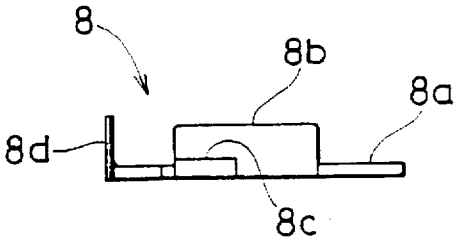
FIG. 5B is a side view illustrating the same.
Figure 6:
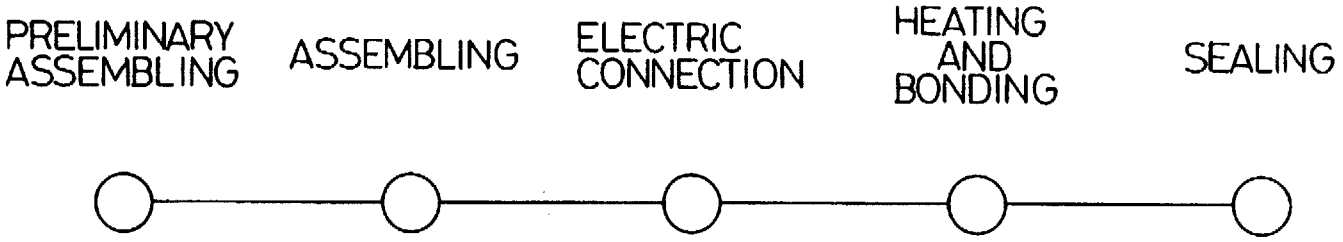
FIG. 6 is a diagram showing a process of manufacturing the ignition coil according to the first embodiment.

As shown in FIGS. 5A and 5B, the holder 8 is made of a resinous material and has a base portion 8*a*, guide portions 8*b*, projections 8*c* and a stopper portion 8*d*. The base portion 8*a* is formed to correspond to the shape of the igniter 7, and the guide portions 8*b* are disposed at opposite sides of the base portion 8*a* so that they extend in the direction vertical to the base portion 8*a*. The projections 8*c* extend horizontally outward from the guide portions 8*b* to engage the grooves 107 of the mount section 100*b* of the case 100 respectively. The stopper portion 8*d* extend vertically from another side (front side) of the holder 8.

The plug-cap section 6 is composed of a cylindrical portion 105 to hold a spark plug therein and a cap member 13 made of rubber. The cup 15 is insert-molded in the case 100 at an upper portion of the plug-cap section 6 to hermetically seal the chamber 102 from the plug-cap section 6. A coil spring 17 is disposed inside the cylindrical portion 105 and fixed to the cup 15 to be in contact with a spark plug inserted therein.

The transformer section 5 is composed of an iron core 502, permanent magnets 504 and 506, a secondary-coil spool 510, a secondary coil 512, a primary-coil spool 514 and a primary coil 516.

The secondary coil spool 510 is a resinous cylindrical member having a bottom 510*a* and the secondary coil 512 is wound around the periphery thereof. A terminal plate 34 is fixed to the outside surface of the bottom 510*a*, and a lead wire extending from the secondary coil 512 is connected to the terminal plate 34. A coil spring 27 is disposed between the terminal plate 34 and the cup 15 to connect them. When a high voltage is generated by the secondary coil 512, it is supplied to the spark plug (not shown) through the terminal plate 34, spring 27, cup 15 and spring 17.

The primary-coil spool 514 is also a cylindrical member having a bottom and an upper opening, and the primary coil 516 is wound therearound. The upper opening thereof is covered by a cap 514*a*. An auxiliary core 508 which has a plurality of slits is disposed around the primary-coil spool 514 to suppress leakage of the magnetic flux. A pair of terminal pins 512*a* are insert-molded in the primary-coil spool 514 and connected to the primary coil 516 and other electric parts (not shown). The terminal pins 512*a* can be welded to the spool 514 by heating a portion of the spool 514.

The insulating oil 29 is filled in the chamber 102 of the case 100 with a small air space at an upper portion thereof. The insulating oil 29 is filled through the through hole at the bottom of the primary-coil spool 514, a center hole 514*b* formed in the cap 514*a*, and the upper opening of the secondary-coil spool 510 and other openings to insulate the iron core 502, secondary coil 512, primary coil 516 and auxiliary core 508 from each other.

(Process of Manufacture)

A process of manufacturing the ignition coil is described with reference to FIGS. 1 to 8. The manufacturing process is composed of the following five steps.

(1) Preliminary Assembling

The transformer section 5, plug-cap section 6, holder 8 and igniter 7 are respectively assembled.

The transformer section 5 is assembled as follows. The primary coil 516 and secondary coil 512 are wound respectively around the primary-coil spool 516 and secondary-coil spool 510 respectively. Subsequently, the iron core 502 having a pair of the magnets 504 and 506 respectively fixed on the opposite ends thereof is inserted into the central space of the secondary-coil spool 510, which is inserted into the central space of the primary-coil spool 514. The primary-coil spool 514 is thereafter covered with the auxiliary core 508.

The plug-cap section 6 is assembled as follows. The cup 15 is insert-molded in the case 100, in which the springs 17 and 27 are installed.

The igniter 7 is fixed to the holder 8 by an adhesive agent that has a short hardening time.

(2) Assembling

Figure 7:
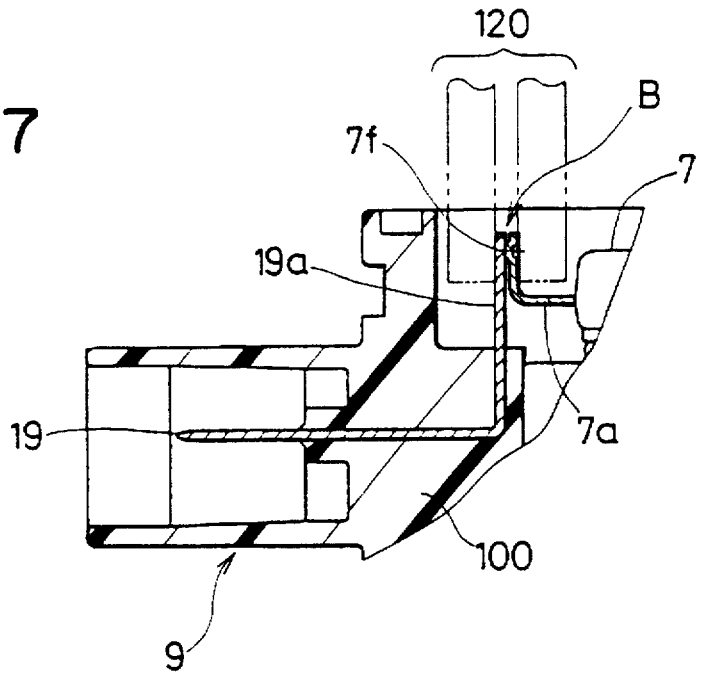
FIG. 7 is a cross-sectional view illustrating a portion of the ignition coil shown in FIG. 1 cut along a line indicated by VII—VII.
Figure 8:
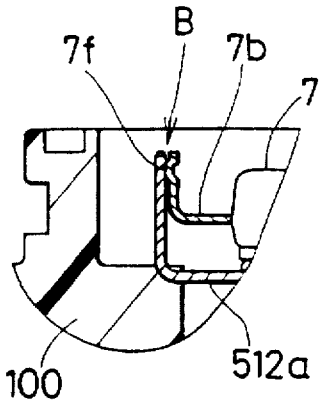
FIG. 8 is a cross-sectional view illustrating a portion of the ignition coil shown in FIG. 1 cut along a line indicated by VIII—VIII.

The transformer section 5 is put into the chamber 102 through the upper opening 10*a*, and then the igniter 7 together with the holder 8 is put on the top of the transformer section 5. At the same time, the high-side terminal of the secondary coil 512 is connected to the spring 27, and the projections 8*c* of the holder 8 are inserted into the grooves 107 of the mount section 100*b* and adjusted so that the input and output pins 7*a* and 7*b* are positioned properly with respect to the connector pins 19 and the terminal pins 512*a* as shown in FIGS. 7 and 8.

(3) Electrical Connection

The input pins 7*a* of the igniter 7 are connected to the connector pins 19 respectively, and the input pins 7*b* are connected to the terminal pins 512*a*. Since the input and output pins 7*a* and 7*b* are positioned properly, no stress is applied to any of the input and output pins 7a and 7b, the connector pins 19 and the terminals 512a after they are connected or welded together by a resistance welder 120 at a portion B shown in FIGS.7 and 8.

(4) Heating and Bonding

Portions A of the projections 8c of the holder 8 and the mount sections 100b are heated to melt into one another to bond the holder 8 to the case 100 as shown in FIG. 1.

(5) Sealing

The insulating oil 29 is poured into chamber 102 of the case 100 through the upper opening 100a, and the metal cover 31 is placed on the top of the case 100 and caulked thereto, thereby sealing the cover 31 hermetically.

(Second Embodiment)

Figure 10:
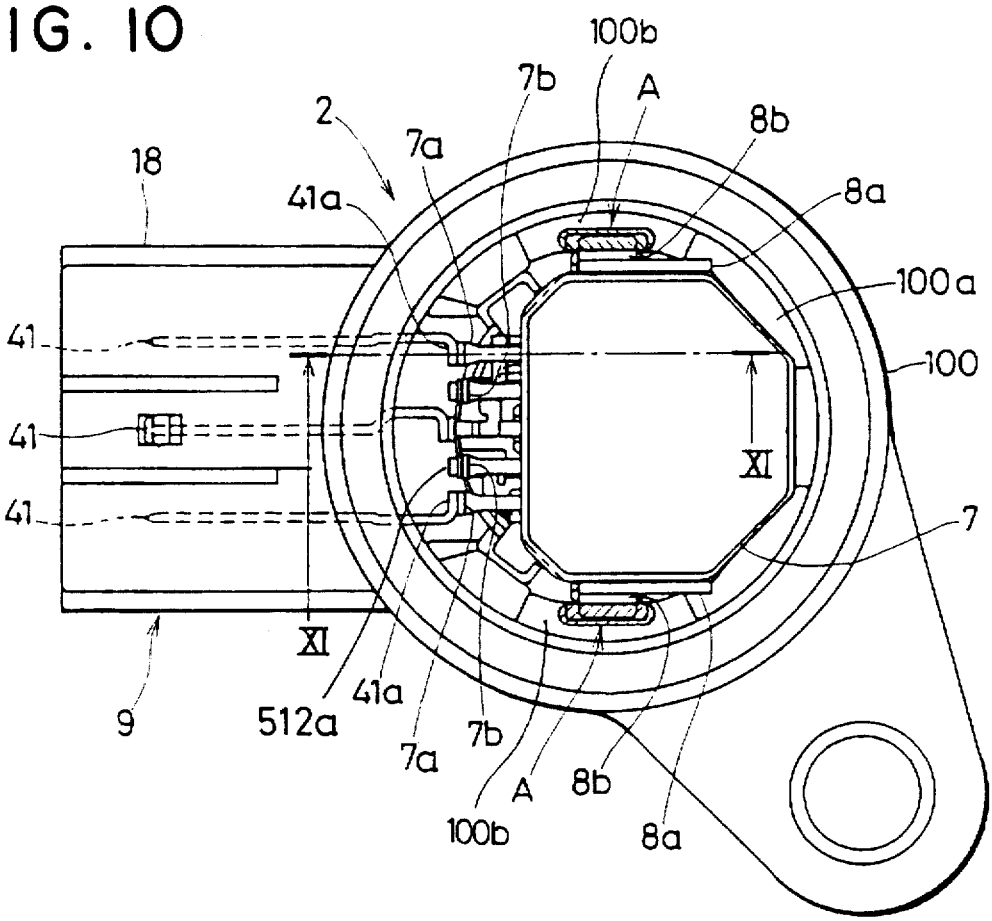
FIG. 10 is a plan view illustrating an ignition coil without an ignition cap according to a second embodiment of the present invention.
Figure 11:
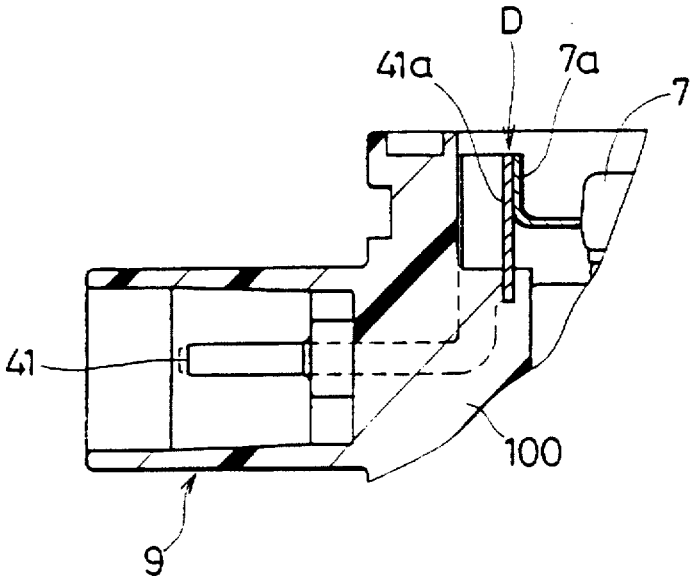
FIG. 11 is a cross-sectional view illustrating a portion of the ignition coil shown in FIG. 10 cut along a line indicated by XI—XI.

An ignition coil according to a second embodiment of the present invention is described with reference to FIGS. 10 and 11. The same or substantially the same parts or portions as the first embodiment are designated by the same reference numerals as the first embodiment, and detailed descriptions thereof are omitted.

In the ignition coil according to the second embodiment has flat connector pins 41 extending in the longitudinal direction of the ignition coil 2. The flat connector pins 41 have L-shaped ends, which are connected to the input pins 7a at a portion D as shown in FIG. 11 before the igniter 7 with the holder 8 is bonded to the case at the portion A.

(Third Embodiment)

Figure 12:
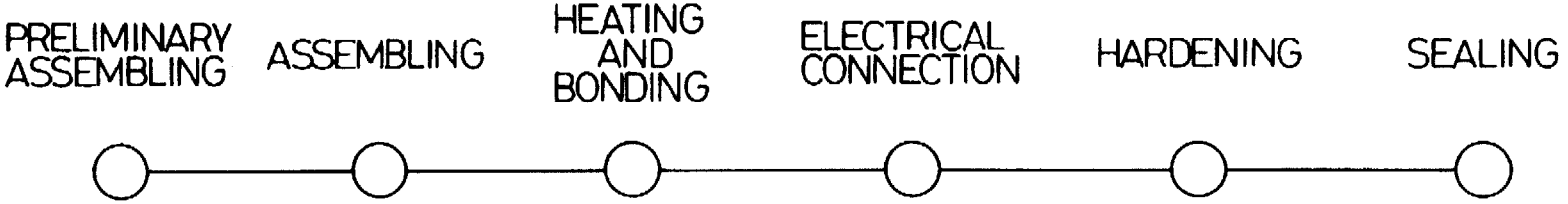
FIG. 12 is a diagram showing a process of manufacturing an ignition coil according to a third embodiment of the present invention.

A process of manufacturing the ignition coil 2 according to a third embodiment is described with reference to FIG. 12.

(11) Preliminary Assembling

The transformer section 5, plug-cap section 6, holder 8 and igniter 7 are respectively assembled.

The igniter 7 is temporarily fixed to the holder 8 by an adhesive agent, such as a room-temperature-setting adhesive, thermo-setting adhesive or ultraviolet-ray-setting adhesive that has a long hardening time instead of an agent having a short hardening time as used in the first embodiment.

(12) Assembling

The transformer section 5 is put into the chamber 102 through the upper opening 100a, the igniter 7 with the holder 8 is put on the top of the transformer section 5 and substantially the same steps as the first embodiment follows.

(13) Heating and Bonding

Portions A of the projections 8c of the holder 8 and the mount sections 100b are heated to melt into one another to bond the holder 8 to the case 100 in the same manner as the step (4) according to the first embodiment.

(14) Electrical Connection

The input pins 7a of the igniter 7 are connected to the connector pins 19 respectively, and the input pins 7b are connected to the terminals 512a in the same manner as the step (3) of the first embodiment. The position of igniter 7 can be adjusted for the connection because the case 100 and the holder are not rigidly bonded because of the long adhesive hardening time.

(15) Hardening

If the room-temperature-setting adhesive is used in the preliminary assembling step (11), the ignition coil 2 is left as it is for a suitable time for hardening. If the thermosetting adhesive is used, the ignition coil 7 or the portion where the adhesive is applied is heated at a suitable temperature for a prescribed time for hardening. And if the ultraviolet-ray-setting adhesive is used, a ultraviolet-ray of a suitable frequency is applied to the portion where the ultraviolet-ray-setting adhesive is applied for a prescribed time.

(16) Sealing

The insulating oil 29 is poured into chamber 102 of the case 100 through the upper opening 100a, and the metal cover 31 is placed on the top of the case 100 and caulked thereto, thereby sealing hermetically in the same manner as the step (5) of the first embodiment.

Figure 13:
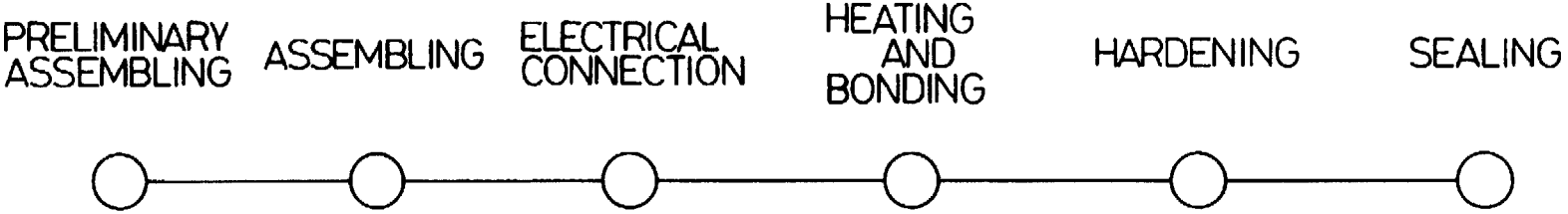
FIG. 13 is a diagram showing a variation of the process of manufacturing the ignition coil according to the third embodiment.

Another variation of the process of manufacturing the ignition coil is shown in FIG. 13. This process is composed of (21) Preliminary Assembling, (22) Assembling, (23) Electrical Connection, (24) Heating and Bonding, (25) Hardening and (26) Sealing. The order of the steps of Electrical Connection and Heating and Bonding is different from the order shown in FIG. 12. Accordingly, the projections 8c of the holder 8 can be moved more easily along the grooves 107 to adjust the position of the igniter 7. Other steps are the same as those according to the third embodiment shown in FIG. 12.

(Fourth Embodiment)

Figure 14:
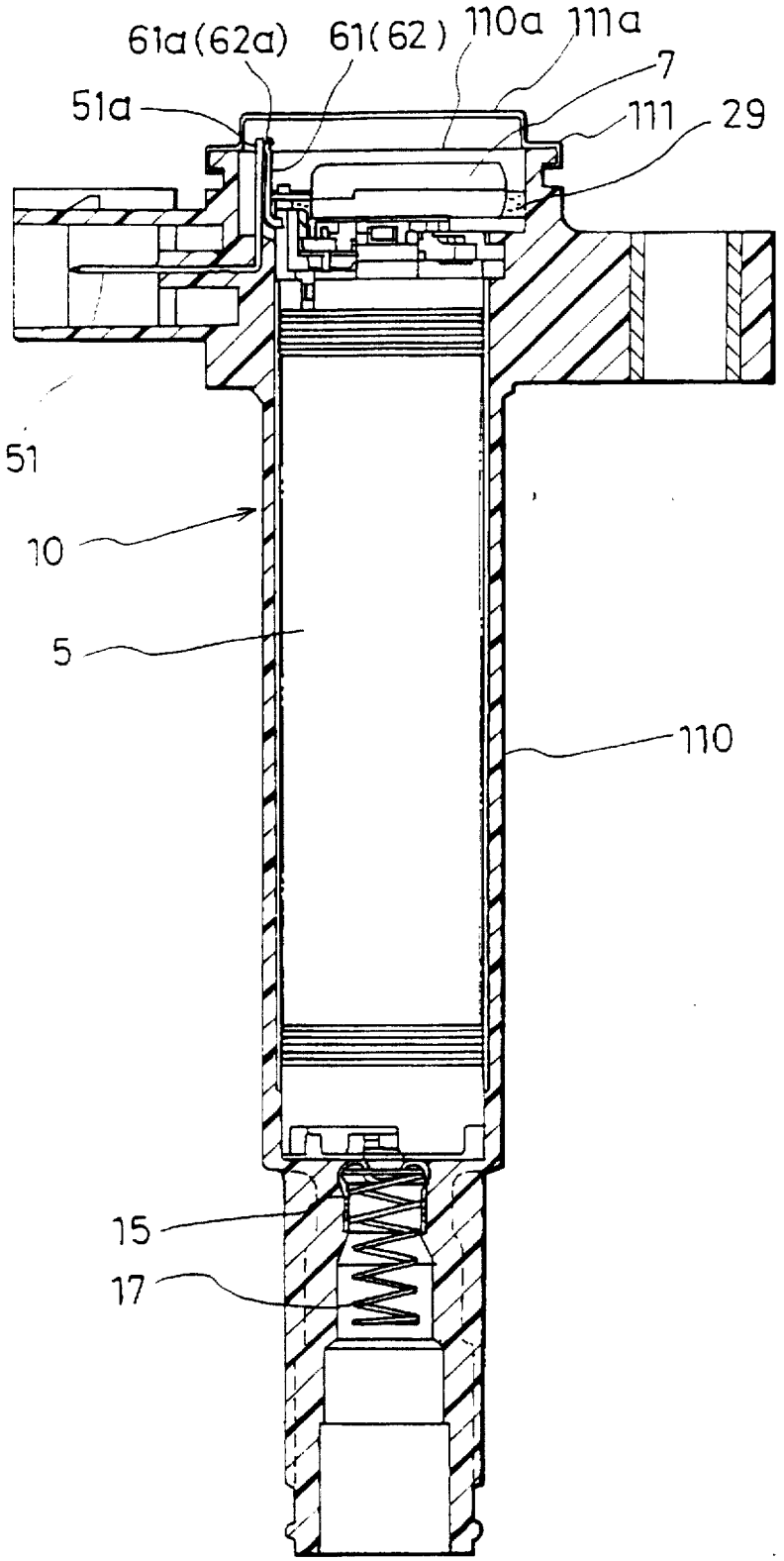
FIG. 14 is a cross-sectional side view illustrating an ignition coil according to a fourth embodiment of the present invention.
Figure 15:
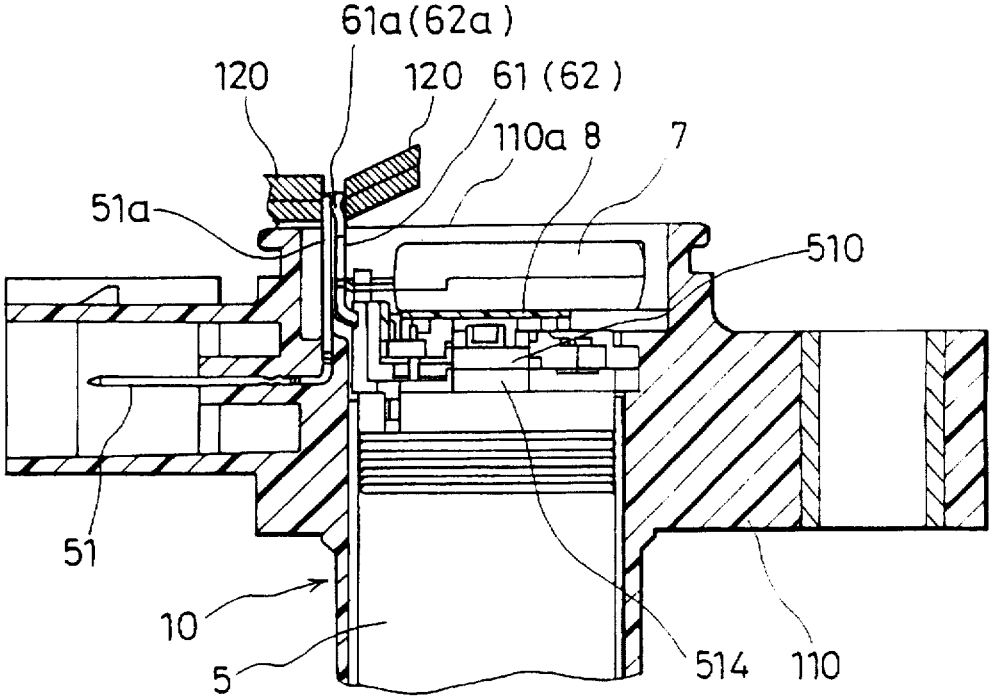
FIG. 15 is a schematic view illustrating a process of connecting terminals of the ignition coil according to the fourth embodiment.

An ignition coil according to a fourth embodiment is described with reference to FIGS. 14 and 15. The same or substantially the same parts or portions are designated by the same reference numerals, and detailed descriptions thereof are omitted.

In the ignition coil 10 according to the fourth embodiment, each end 51a of the connector pins 51 extends to the outside from an opening 110a of a case 110 with each corresponding projection 61a of the input pins 61 and each corresponding projection 62a of the output pins 62. Terminals connected to the coil ends of the primary coil and the secondary coil also extend from the opening 110a. A cover 111 has a convex portion for accommodating various terminals and members extending from the openings.

After the igniter 7 is positioned on the case 110, the projection 61a and the end 51a of the connector pin 51 and also the projection 62a and the coil end of the primary coil are pressed and welded by the electrodes 120, which can be located outside the case. As a result, a space of the case 110 for accommodating the electrode is not necessary.

The holder 8 is thereafter heated and bonded to the case 110, and the insulating oil 29 is poured into the case 110. The cover 111 is caulked to the upper end of the opening 110a of the case 110.

(Fifth Embodiment)

Figure 16:
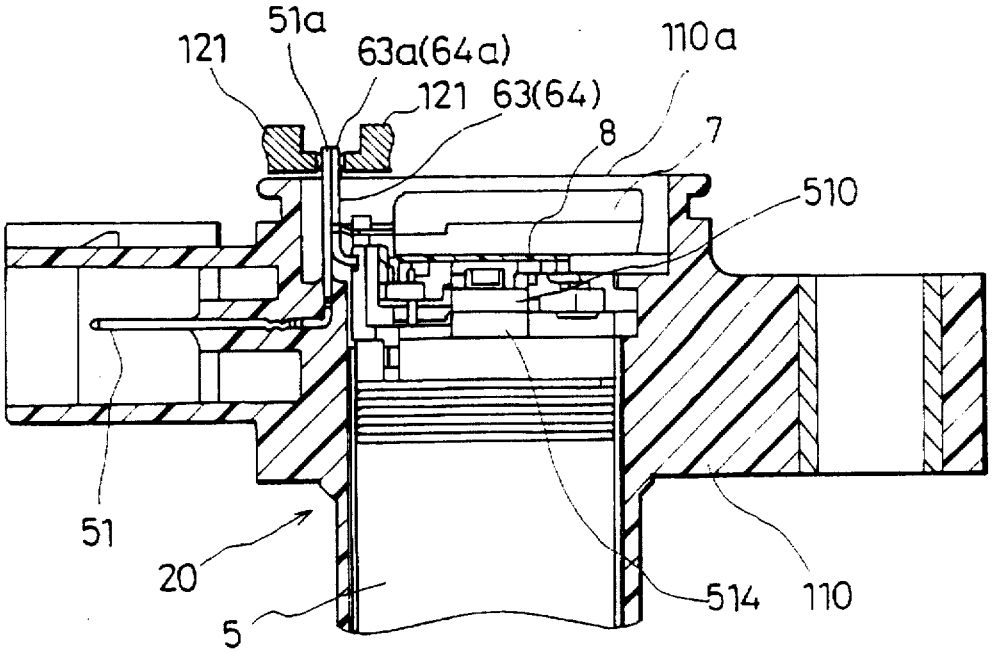
FIG. 16 is a schematic view illustrating a process of connecting terminals of an ignition coil according to a fifth embodiment of the present invention.

An ignition coil according to a fifth embodiment is described with reference to FIG. 16. The same or substantially the same parts and portions are designated by the same reference numerals and detailed descriptions thereof are omitted.

Input pins 63 and output pins 64 have flat ends 63a and 64a. To connect these, the electrodes 121 of the resistance welder have projections for collecting the welding current. The igniter 7 can be fixed to the case 110 without the holder 8.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. An ignition coil having a transformer, the ignition coil comprising:

an igniter having a control circuit for controlling generation of high voltage;

a housing having an opening to allow said igniter to pass therethrough and a fixing portion for fixing said igniter, said fixing portion disposed at a location easily accessible from said opening;

a terminal pin disposed at a location said igniter easily accessible from said opening and connected to said control circuit; and a connector pin fixed to said housing and connected to said terminal pin.

2. An ignition coil as claimed in claim 1, wherein said igniter has a projection at a side thereof that is bonded to said housing.

3. An ignition coil as claimed in claim 1, wherein said terminal pin and connector pin extend outwardly from said opening.

4. An ignition coil as claimed in claim 3, wherein said terminal pin and connector pin are connected by resistance welding.

5. An ignition coil comprising:

a transformer having primary coil, a secondary coil and spools for said primary and secondary coils;

an igniter for controlling generation of high voltage of said secondary coil;

a housing having an opening to allow said transformer and igniter to pass therethrough, a chamber accommodating said transformer and igniter and a fixing portion disposed at a location easily accessible from said opening to fix said igniter;

a terminal pin connected to said igniter and extending outside from said housing; and a connector pin fixed to said housing and connected to said terminal pin at a portion thereof outside said housing.

6. An ignition coil as claimed in claim 5, wherein said igniter and said fixing portion have a member for adjusting a relative location therebetween to connect said connector pin and said terminal pin without stress.

* * * * *